US009605450B2

(12) United States Patent
Puscas et al.

(10) Patent No.: US 9,605,450 B2
(45) Date of Patent: Mar. 28, 2017

(54) VEHICLE DOOR CLOSURE SYSTEM INCLUDING SPEED-BASED LATCH RELEASE

(71) Applicant: Ford Global Technologies, LLC, Dearborn, MI (US)

(72) Inventors: Livianu Dorin Puscas, Rochester Hills, MI (US); Kosta Papanikolaou, Huntington Woods, MI (US); Bhupendra A. Patel, Canton, MI (US); David Manuel Rogers, Southfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 198 days.

(21) Appl. No.: 14/282,663

(22) Filed: May 20, 2014

(65) Prior Publication Data

US 2015/0337567 A1 Nov. 26, 2015

(51) Int. Cl.

| | |
|---|---|
| ***E05B 3/00*** | (2006.01) |
| ***E05B 77/06*** | (2014.01) |
| ***E05B 77/04*** | (2014.01) |
| ***E05B 77/22*** | (2014.01) |
| ***E05B 79/20*** | (2014.01) |

(52) U.S. Cl.

CPC ..... *E05B 77/06* (2013.01); *E05B 77/04* (2013.01); *E05B 77/22* (2013.01); *E05B 79/20* (2013.01); *Y10S 292/22* (2013.01); *Y10T 292/1083* (2015.04); *Y10T 292/57* (2015.04)

(58) Field of Classification Search

CPC ..... B62D 21/157; E05B 77/04; E05B 77/06; E05B 79/20; E05B 79/22; Y10T 292/1083; Y10T 292/57; Y10S 292/22

USPC ..... 292/198, 202, 216, 336.3, DIG. 22, 292/DIG. 23; 296/187.12

See application file for complete search history.

(56) References Cited

U.S. PATENT DOCUMENTS

| | | | | |
|---|---|---|---|---|
| 3,990,531 A | | 11/1976 | Register | |
| 4,683,774 A | * | 8/1987 | Memmola | E05B 47/0012 74/502.4 |
| 5,037,145 A | * | 8/1991 | Wilkes | E05B 81/25 292/201 |
| 5,669,642 A | | 9/1997 | Kang | |
| 6,007,122 A | | 12/1999 | Linder et al. | |
| 6,042,159 A | | 3/2000 | Spitzley et al. | |

(Continued)

FOREIGN PATENT DOCUMENTS

| | | | | |
|---|---|---|---|---|
| AT | DE 10002215 C1 | * | 10/2001 | F16C 1/226 |
| DE | 202006011206 U1 | * | 11/2007 | E05B 77/06 |

(Continued)

*Primary Examiner* — Kristina Fulton
*Assistant Examiner* — Christine M Mills
(74) *Attorney, Agent, or Firm* — Jason C. Rogers; Price Heneveld LLP

(57) ABSTRACT

A vehicle door includes a door structure and a movable door handle that is connected to a latch mechanism by a cable. A rotatably biased stop member is connected to the cable. The vehicle door further includes a housing having a channel that receives portion of the stop member. The channel includes first and second linear portions and a transverse stop portion that is engaged by the follower to prevent further lengthwise movement of the lock member and cable if a speed of the cable exceeds an allowable value.

16 Claims, 2 Drawing Sheets

(56) References Cited

U.S. PATENT DOCUMENTS

| | | | | |
|---|---|---|---|---|
| 6,241,294 | B1 | 6/2001 | Young et al. | |
| 6,712,409 | B2 * | 3/2004 | Monig | E05B 77/06 292/336.3 |
| 6,971,688 | B2 | 12/2005 | Drysdale et al. | |
| 7,070,212 | B2 | 7/2006 | Spurr | |
| 7,097,212 | B2 * | 8/2006 | Willats | E05B 51/02 292/1 |
| 7,481,468 | B2 | 1/2009 | Merideth et al. | |
| 7,635,151 | B2 | 12/2009 | Rodawold, Jr. et al. | |
| 7,686,355 | B2 | 3/2010 | Jankowski et al. | |
| 7,810,852 | B2 * | 10/2010 | Alacqua | E05B 47/0009 292/144 |
| 8,029,032 | B1 | 10/2011 | Yang | |
| 8,152,209 | B2 | 4/2012 | Lee | |
| 8,303,004 | B2 | 11/2012 | Lee et al. | |
| 8,322,077 | B2 | 12/2012 | Papanikolaou et al. | |
| 8,366,159 | B2 | 2/2013 | Patel | |
| 8,701,817 | B2 | 4/2014 | Schoen | |
| 8,814,232 | B2 | 8/2014 | Bertolotti | |
| 8,899,640 | B2 * | 12/2014 | Bertolotti Potachin | E05B 77/06 292/336.3 |
| 2005/0184537 | A1 | 8/2005 | Le et al. | |
| 2007/0120382 | A1 * | 5/2007 | Chevalier | E05B 77/06 292/336.3 |
| 2009/0223263 | A1 | 9/2009 | Puscas et al. | |
| 2010/0301618 | A1 * | 12/2010 | Costigan | E05B 77/06 292/93 |
| 2010/0320777 | A1 | 12/2010 | Jankowski et al. | |
| 2013/0056999 | A1 | 3/2013 | Beck | |
| 2014/0015263 | A1 | 1/2014 | Da Deppo et al. | |
| 2014/0097624 | A1 | 4/2014 | Papanikolaou et al. | |
| 2014/0132008 | A1 | 5/2014 | Bendel et al. | |
| 2014/0145454 | A1 | 5/2014 | Da Deppo et al. | |
| 2015/0337566 | A1 * | 11/2015 | Wittelsbuerger | E05B 77/06 292/194 |

FOREIGN PATENT DOCUMENTS

| | | | | |
|---|---|---|---|---|
| DE | 102009038612 | A1 * | 3/2011 | E05B 51/023 |
| DE | 202010014992 | U1 * | 1/2012 | E05B 77/06 |
| DE | 202013103708 | U1 * | 11/2014 | E05B 77/06 |
| WO | 2013093092 | A1 | 6/2013 | |

* cited by examiner

VEHICLE DOOR CLOSURE SYSTEM INCLUDING SPEED-BASED LATCH RELEASE

FIELD OF THE INVENTION

The present invention generally relates to doors for motor vehicles, and more particularly, to a speed-based device that is configured to prevent unlatching of a door latch in the event of a side impact.

BACKGROUND OF THE INVENTION

Vehicle door latches may include a movable "claw" that engages a striker to retain the vehicle door in a closed position. When the latch is latched, a movable pawl prevents movement/release of the claw from an engaged position to prevent the vehicle door from opening. The pawl may be mechanically connected to interior and/or exterior door handles by elongated linkage such as a cable whereby movement of the handles shifts the pawl to a released (unlatched) position wherein the pawl permits the claw to move and disengage from the striker.

During a side impact on a vehicle door, the door handle tends to move outwardly due to the inertia of the handle. This movement of the door handle can cause unlatching of the latch. Door handles may include counter weights or the like that are designed to prevent movement of the door handle in a side impact to thereby prevent unlatching of the latch. However, known arrangements may suffer from various drawbacks.

SUMMARY OF THE INVENTION

One aspect of the present invention is a vehicle door including a door structure that is configured to be movably mounted to a vehicle. The door includes a latch mechanism configured to releasably engage a striker to retain the door in a closed position. The door also includes a movable handle member mounted to the door structure, and an elongated flexible member operably interconnecting the handle member and the latch mechanism such that a user can move the handle and shift the elongated flexible member to unlatch the latch mechanism. The vehicle door further includes a speed-based locking device that is operably connected to the elongated flexible member to prevent or limit lengthwise shifting/movement of the elongated flexible member to prevent unlatching of the latch mechanism if the elongated flexible member initially moves at a speed that is above an allowable value. The speed-based locking device includes a base or housing mounted to the door structure. The housing extends around at least a portion of the elongated flexible member. The locking device also includes a lock member connected to the elongated flexible member such that lengthwise movement of the elongated flexible member moves the lock member in an axial direction. The housing includes spaced apart first and second channel surfaces defining a guide channel having first and second portions extending generally parallel to a lengthwise direction of motion of the elongated flexible member. The first and second portions of the guide channel are offset relative to one another, and the guide channel includes a transverse portion extending between and interconnecting the first and second portions. The second channel surface of the housing defines a stop surface adjacent to the transverse portion of the channel. The stop member includes a protrusion or follower that is movably disposed in the guide channel. The protrusion is biased into contact with the first channel surface such that the protrusion travels along the guide channel from a first position in the first portion of the channel to a released position in the second portion of the channel without engaging the stop surface if the elongated flexible member is shifted lengthwise relative to the housing at a speed that is at or below the allowable value. The protrusion contacts the stop surface and prevents further lengthwise movement of the elongated flexible member if the elongated flexible member initially moves at a speed that exceeds the allowable value.

Another aspect of the present invention is a vehicle door including a door structure and a movable door handle that is connected to a latch mechanism by a cable. A rotatably biased stop member is disposed on the cable. The vehicle door further includes a housing having a channel that receives a portion of the stop member. The channel includes first and second linear portions and a transverse stop portion that is engaged by the follower to prevent further lengthwise movement of the lock member if an initial speed of the cable exceeds an allowable value.

Yet another aspect of the present invention is a speed-based locking device that is configured to limit or prevent lengthwise movement of a cable that mechanically interconnects a movable door handle and a latch mechanism of a vehicle door. The speed based locking device includes a base configured to be mounted to a door structure. The locking device further includes a lock member that is configured to be connected to a cable for linear and rotational movement relative to the base. A resilient member rotationally biases the lock member whereby the lock member tends to rotate in a first direction about the cable relative to the base. The base includes a guide surface having first and second portions and a ramp surface extending between the first and second portions. The lock member includes a follower that is biased into engagement with the guide surface. The base also includes a stop surface that is spaced apart from the guide surface whereby the follower engages the stop surface rather than the ramp surface if the cable and lock member are moved relative to the base at a speed exceeding an allowable value whereby rotational inertia of the lock member causes the follower to disengage from the ramp surface.

These and other aspects, objects, and features of the present invention will be understood and appreciated by those skilled in the art upon studying the following specification, claims, and appended drawings.

BRIEF DESCRIPTION OF THE DRAWINGS

In the drawings:

FIG. 3.

DETAILED DESCRIPTION OF THE PREFERRED EMBODIMENTS

Figure 1:
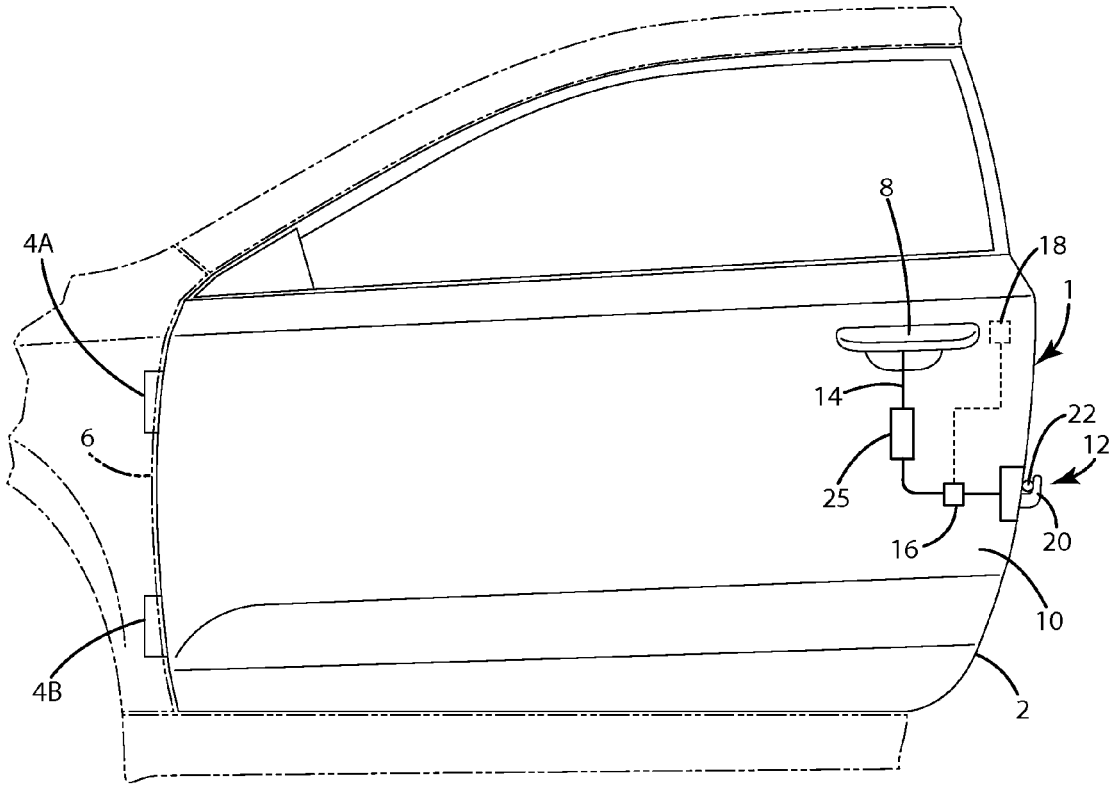
FIG. 1 is a partially schematic view of a vehicle door according to one aspect of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

With reference to FIG. 1, a vehicle door 1 includes a door structure 2 and hinges 4A and 4B that may be utilized to movably mount the vehicle door 1 to a vehicle structure 6 in a known manner. The vehicle door 1 includes a door handle 8 that is movably mounted to the door structure 2 for movement between a first (rest) position and a deployed position. In the illustrated example, the door handle 8 comprises an exterior door handle that is mounted on an exterior side 10 of vehicle door 1. The vehicle door 1 also includes a latch mechanism 12 that is mechanically interconnected with the handle 8 by a flexible cable 14 or other suitable mechanical linkage. The latch mechanism 12 may be substantially similar to conventional latches. Specifically, latch mechanism 12 includes a movable claw 20 that releasably engages a striker 22 mounted to the vehicle structure 6. The latch mechanism 12 may also include a pawl (not shown) that is mechanically connected to the cable 14. Movement of handle 8 shifts the cable 14 to thereby move the pawl from a latched or engaged position to a released or unlatched position. Handle 8 may be biased towards a rest position by a spring such that handle 8 returns to the rest position when it is released by a user. When the pawl is in an engaged or latched position, it prevents movement of claw 20 to prevent claw 20 from disengaging striker 22. If the pawl is moved to a disengaged or unlatched position, the movable claw 20 can move to disengage striker 22 to thereby permit door 1 to be opened. These types of components are well known to those skilled in the art, such that a detailed description of these components and their operation thereof are not believed to be required. The vehicle door 1 may also include a lock mechanism 16 and a lock release button or switch 18. Lock mechanism 16 and lock switch 18 prevent unlatching of latch mechanism 12 if the lock mechanism 16 is in a locked state. The lock mechanism 16 and lock switch 18 may comprise known components that operate in a known manner.

Door 1 also includes a speed-based locking device 25 that is operably interconnected to the cable 14. As discussed in more detail below, the speed-based locking device 25 limits the lengthwise movement of flexible cable 14 if flexible cable 14 initially moves at a speed that is above an allowable value. During a side impact, cable 14 may initially move lengthwise at a speed exceeding 2500 mm/s. However, a human will normally move handle 8 significantly slower, resulting in lengthwise movement of flexible cable 14 less than 150 mm/s.

Figure 2:
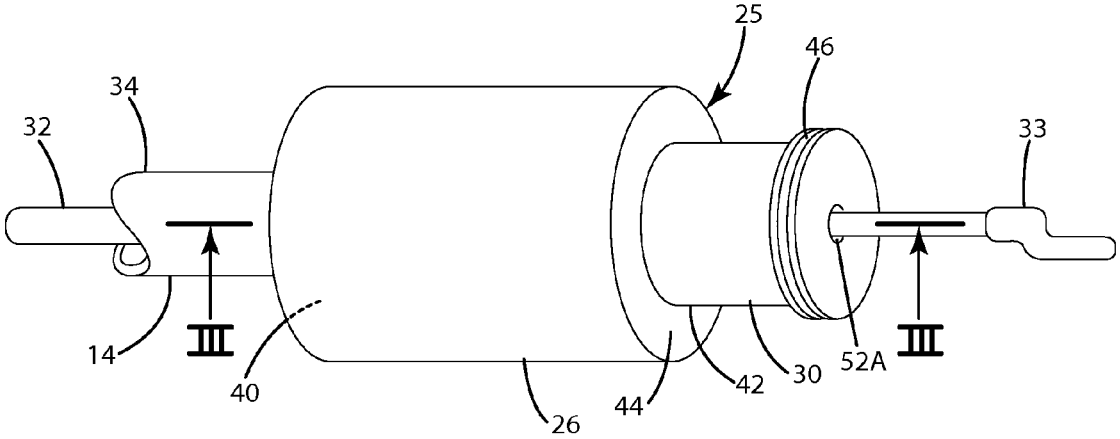
FIG. 2 is a partially fragmentary isometric view of a speed-based device according to one aspect of the present invention.
Figure 3:
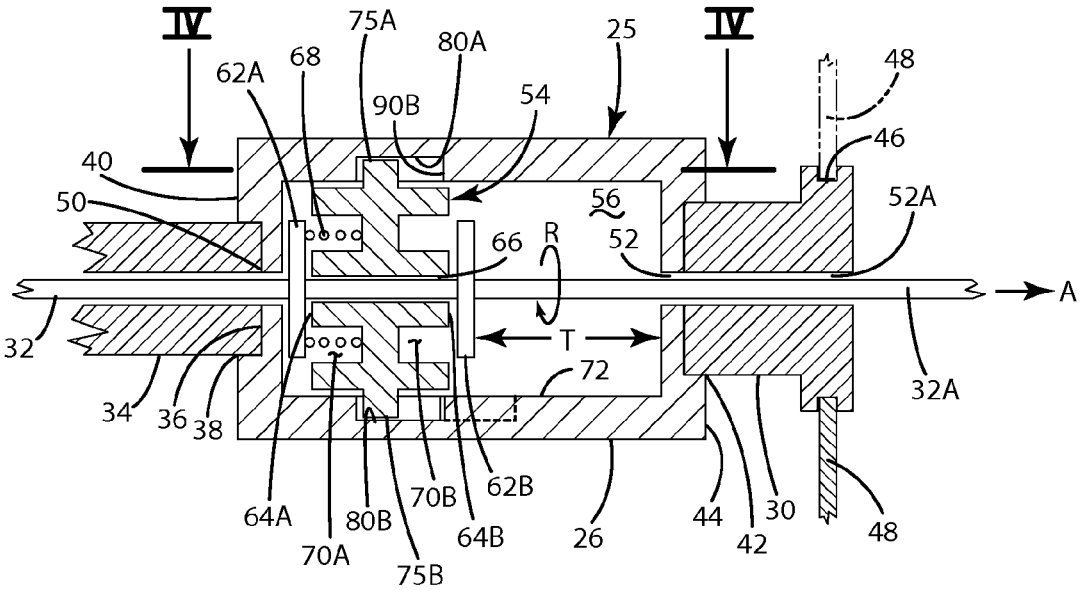
FIG. 3 is a cross sectional view of the device of FIG. 2 taken along the line III-III.

With further reference to FIGS. 2 and 3, the speed-based locking device 25 includes a housing 26 that may comprise metal, polymer, or other suitable material. Cable 14 includes a flexible inner strand 32 and an outer sheath 34. End 36 of sheath 34 may engage a recess or fitting 38 in end wall 40 of housing 26. Speed-based locking device 25 may include a fitting 30 that is disposed in a second recess 42 in a second end wall 44 of housing 26. Fitting 30 includes an annular groove 46 that may be utilized to mount the speed-based locking device 25 to a support structure 48. Support structure 48 may be rigidly secured to door structure 2 such that the housing 26 of speed-based locking device 25 does not move relative to the door structure 2. Alternatively, housing 26 may include a mounting structure (not shown) to mount the housing 26 to door structure 2.

Referring again to FIG. 3, inner strand 32 of cable 14 extends through openings 50 and 52 in end walls 40 and 44, respectively, of housing 26, and through opening 52A in fitting 30. The inner strand 32 of cable 14 can move lengthwise relative to housing 26 in the direction of the arrow "A" and in the opposite direction. An end fitting 33 (FIG. 2) may be fixed to the inner cable strand 32. The end fitting 33 may be utilized to connect the cable strand 32 to the door handle 8 utilizing a bell crank (not shown) or other suitable device known in the art such that rotation of door handle 8 shifts cable strand 32 in a lengthwise manner.

A stop member 54 is disposed on the inner strand 32 of cable 14 in internal cavity 56 of housing 26. Washers 62A and 62B or other suitable retainers are fixed to the inner strand 32 on opposite sides of stop member 54 to thereby prevent or limit movement of stop member 54 along inner strand 32 of cable 14. The washers 62A and 62B may be configured to abut opposite end surfaces 64A and 64B, respectively, of stop member 54 such that the stop member 54 moves axially with inner strand 32 as the inner strand 32 moves lengthwise. Conversely, if stop member 54 is axially restrained such that stop member 54 cannot move in the direction of the arrow A, stop member 54 prevents lengthwise movement of inner strand 32. However, opening 66 of stop member 54 may have a somewhat larger diameter than inner strand 32 such that stop member 54 can rotate about inner strand 32 as indicated by the arrow "R." A torsion spring 68 is interconnected with the housing 26 or washer 62A and stop member 54 to thereby rotationally bias the stop member 54 relative to housing 26. Torsion spring 68 may be at least partially disposed in an annular groove 70A or an annular groove 70B of stop member 54.

Referring again to FIG. 3, housing 26 may include a generally cylindrical inner surface 72 having guide channels 80A and 80B formed in the surface 72. Stop member 54 includes first and second protrusions or followers 75A and 75B, respectively that are movably disposed in the guide channels 80A and 80B. The guide channels 80A and 80B may have substantially similar configurations and shapes, and the protrusions or followers 75A and 75B may be configured to engage the guide channels 80A and 80B, respectively, in substantially the same manner. Accordingly, the following description of the engagement of follower 75A in guide channel 80A also applies to engagement of follower 75B in guide channel 80B.

Figure 4:
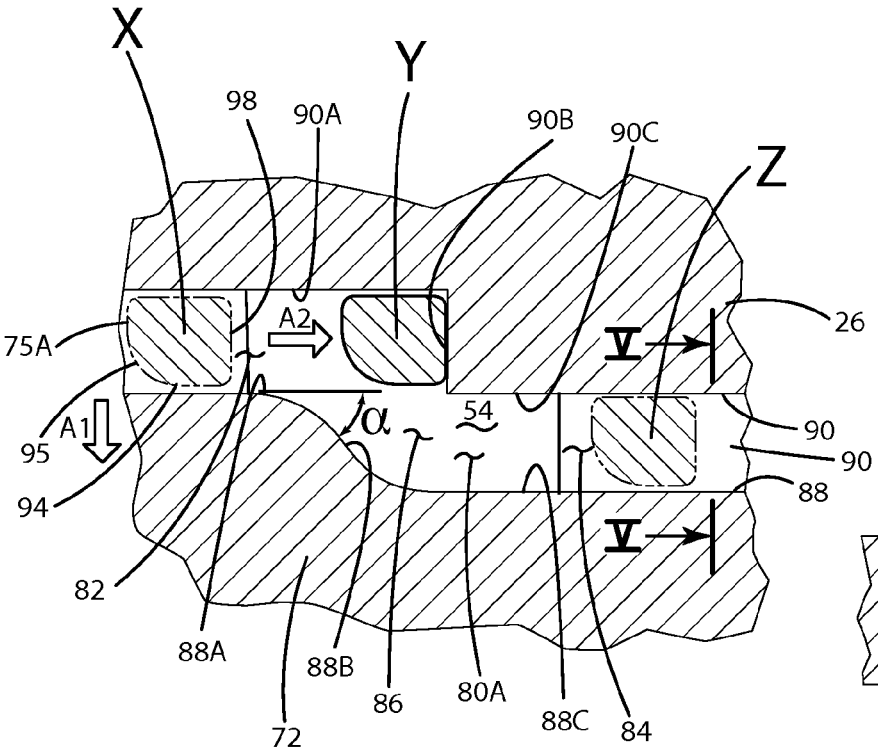
FIG. 4 is a partially fragmentary view of a portion of the speed-based device taken along the line IV-IV.
Figure 5:
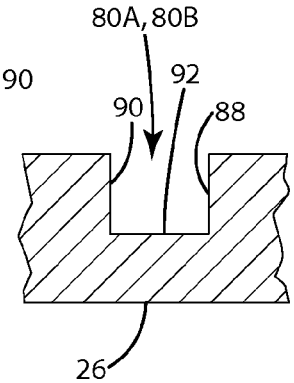
FIG. 5 is a cross sectional view of the guide channel of FIG. 4 taken along the line IV-IV.

With reference to FIG. 4, guide channel 80A in inner surface 72 of housing 26 includes a generally linear first portion 82, a generally linear second portion 84, and a transverse portion 86 extending between the first and second portions 82 and 84, respectively. Channel 80A includes a base surface 92 and first and second side or guide surfaces 88 and 90, respectively, such that channel 80A is generally U-shaped in cross section, and opens inwardly towards cavity 56 of housing 26 (see also FIG. 5). Torsion spring 68 rotationally biases stop member 54 such that follower 75A is biased towards guide surface 88 of guide channel 80A in the direction of the arrow "A1." A follower surface 94 of follower 75A slidably engages first guide surface 88.

During operation, if a user pulls outwardly on door handle 8 (FIG. 1), thereby shifting the inner cable strand 32, movement of the inner strand 32 will cause stop member 54 to move axially in the direction of the arrow A (FIG. 3). As the stop member 54 moves, the follower 75A is initially at a first or rest position "X" (FIG. 4). If the inner cable strand 32 is moved slowly (i.e. below a predefined maximum allowable speed), the biasing force of spring 68 will cause the follower 75A to remain in contact with the first guide surface 88 as the follower 75A moves from the first position X to a fully extended or deployed position "Z." Specifically, the follower surface 94 and/or curved surface 95 of follower 75A slides along a first linear guide surface portion 88A in the direction of arrow "A2", then along a ramped or angled guide surface portion 88B, then along a generally linear guide surface portion 88C until the follower reaches the position "Z." When a user releases handle 8, the handle 8 returns to the rest or first position, thereby shifting inner cable strand 32 lengthwise in a direction opposite the arrow A (FIG. 3). As the inner cable strand 32 moves back to its starting or rest position, follower 75A moves from position Z to position X. As the follower 75A moves from position Z to position X, the follower surface 94 and/or curved surface 95 of follower 75A slides along the guide surfaces 88C, 88B, and 88A. The torsional bias of spring 68 in the direction of the arrow A1 causes the follower surfaces 94 and/or 95A to remain in contact with the first guide surface 88. The ramped or angled guide surface 88B allows the follower 75A to slide along the guide surface 88 due to the bias tending to return handle 8 to its rest or first position. The ramped guide surface 88B defines an angle $\alpha$ relative to linear surface portion 88A. Angle $\alpha$ is preferably about 45° or less and more preferably about 30° or less to ensure that follower 75A slides along surface 88B. The followers 75A and 75B and the surfaces of the guide channels 80A and 80B may comprise low friction surfaces (e.g. polymer) to reduce friction.

If a side impact force causes handle 8 to move outwardly at a high speed, thereby shifting inner cable strand 32 lengthwise at a high speed, follower 75A shifts from the first position X to a stopped position Y as shown in FIG. 4. Specifically, second guide surface 90 may include a first portion 90A and stop surface 90B that is substantially orthogonal to the surface portions 90A and 90C. If stop member 54 is moved axially at a high enough speed in the direction of the arrow "A2," the rotational inertia of stop member 54 will reduce the rotational acceleration (and rotational velocity) of stop member 54 due to bias from torsion spring 68. This results in follower 75A disengaging from ramp surface 88B such that the engagement surface 98 of follower 75A comes into contact with stop surface 90B, thereby preventing further axial movement of stop member 54. As discussed above, washers 62A and 62B (FIG. 3) restrict or prevent movement of stop member 54 axially along inner cable strand 32. Thus, engagement of follower 70A with stop surface 90B prevents further lengthwise movement of cable 32. The speed-based locking device 25 thereby prevents or limits lengthwise movement of cable strand 32 if cable strand 32 is initially moved at a speed that is above a predefined maximum allowable speed to thereby prevent unlatching of latch mechanism 12 if handle 8 is opened at a high speed due to an impact.

The rotation inertia of stop member 54 and the spring constant of torsion spring 68, and the geometry and dimensions of the protrusions 75A and guide channels 80A and 80B may be configured as required to provide a maximum allowable speed at which inner cable 32 can be moved. If inner cable 32 is moved at a rate that is above the maximum allowable rate, the followers 75A and 75B will engage the stop surfaces 90 of the guide channels 80A and 80B, preventing further lengthwise movement of cable 32 to thereby prevent unlatching of latch mechanism 12. As discussed above, users generally open handle 8 at a rate causing cable 32 to move at a speed of 150 mm/s or less, whereas side impact events may cause cable 32 to move at speeds exceeding 2500 mm/s. The speed-based locking device 25 can be configured to prevent unlatching of latch mechanism 12 if the cable speed exceeds 150 mm/s. However, the speed-based locking device may be configured to prevent/limit cable movement at different maximum allowable speeds as may be required for a particular application. For example, the maximum allowable velocity could be 2500 mm/s, or other values between 150 mm/s and 2500 mm/s. The geometry of handle 8 and the associates linkage (e.g. bellcrank) may result in higher or lower cable speeds based on a given handle movement speed. Thus, the speed-based locking device 25 may be configured to provide a specific maximum allowable speed as required for a particular application. However, because the locking device 25 is actuated (locked) based on speed, specific inertial counterweights or other features designed to prevent movement of handle 8 are not required. Also, the locking device of the present invention may be utilized in connection with both interior and exterior door handles or other latch release mechanisms (e.g. liftgate, trunk, or hood release levers/handles).

It is to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. A vehicle door comprising:

a door structure configured to be movably mounted to a vehicle;

a latch mechanism configured to releasably engage a striker to retain the door in a closed position;

a movable handle member mounted to the door structure;

an elongated flexible member operably interconnecting the handle member and the latch mechanism whereby a user can move the handle member and shift the elongated flexible member to unlatch the latch mechanism; and a speed-based locking device that is operably connected to the elongated flexible member to selectively limit shifting of the elongated flexible member to prevent unlatching of the latch mechanism if the elongated flexible member initially moves at a speed in units of length divided by time that is above an allowable value, the speed-based locking device including a base mounted to the door structure, the locking device further including a stop member connected to the elongated flexible member whereby lengthwise movement of the elongated flexible member moves the stop member in an axial direction, wherein the base includes a guide surface having first and second portions extending generally parallel to a lengthwise direction of motion of the elongated flexible member, wherein the first and second portions are offset relative to one another, and wherein the guide surface includes a ramped portion extending between the first and second portions of the guide surface, the base defining a stop surface that is spaced apart from the ramped portion of the guide surface, and wherein the stop member includes a follower that movably engages the guide surface, and wherein the follower is biased into contact with the guide surface such that the follower travels along the guide surface from a first position to a released position and rotates the stop member without engaging the stop surface if the elongated flexible member is shifted lengthwise relative to the base at a speed in units of length divided by time that is at or below the allowable value, and wherein the follower moves linearly without rotating the stop member and contacts the stop surface and prevents further lengthwise movement of the elongated flexible member if the elongated flexible member initially moves at a speed in units of length divided by time that exceeds the allowable value in units of length divided by time.

2. The vehicle door of claim 1, wherein:

the elongated flexible member defines an axis; and the speed-based locking device includes a torsion spring that rotationally biases the stop member about the axis to bias the follower into contact with the guide surface.

3. The vehicle door of claim 2, wherein:

the base includes a second surface that is spaced from the guide surface to define a guide channel therebetween, wherein the second surface includes first and second portions that are spaced apart from the first and second portions, respectively, of the guide surface, the second surface including a transverse portion extending transversely between the first and second portions of the second surface to define the stop surface.

4. The vehicle door of claim 3, wherein:

the stop surface is substantially planar.

5. The vehicle door of claim 4, wherein:

the follower comprises a protrusion having a substantially planar engagement surface that engages the stop surface if the elongated flexible member initially moves at a speed that exceeds the allowable speed.

6. The vehicle door of claim 5, wherein:

the ramped portion extends at an angle between the first and second portions of the guide surface whereby the protrusion slides along the second portion, the ramped portion, and the first portion of the guide surface as the protrusion is moved from the released position to the first position.

7. The vehicle door of claim 6, wherein:

the elongated flexible member defines an axis; and the ramped portion extends at an angle of less than about sixty degrees relative to the axis.

8. The vehicle door of claim 7, wherein:

the first and second portions of the guide surface are substantially planar.

9. The vehicle door of claim 8, wherein:

the first and second portions of the second surface are substantially linear.

10. The vehicle door of claim 6, wherein:

the protrusion includes a convexly curved follower surface that slidably engages the ramped portion of the guide surface.

11. The vehicle door of claim 1, wherein:

the guide surface comprises a first guide surface and the follower comprises a first follower that extends in a first direction;

the stop member includes a second follower extending in a second direction that is generally opposite the first direction; and wherein:

the base comprises a housing that includes a second guide surface that is substantially identical to the first guide surface, and wherein the second follower engages the second guide surface.

12. The vehicle door of claim 1, wherein:

the elongated flexible member comprises a cable.

13. The vehicle door of claim 1, wherein:

the base comprises a housing having a cavity; and the stop member is movably disposed in the cavity.

14. A speed-based locking device that is configured to limit lengthwise movement of a cable that mechanically interconnects a movable door handle and a latch mechanism of a vehicle door, the speed-based locking device comprising:

a base configured to be mounted to a door structure;

a lock member configured to be connected to a cable for linear and rotational movement relative to the base; and a resilient biasing member engaging the lock member whereby the lock member tends to rotate in a first direction about the cable relative to the base; and wherein:

the base includes a guide surface having first and second portions and a ramp surface extending between the first and second portions, and wherein the lock member includes a follower that is biased into engagement with the guide surface, the base including a stop surface that is spaced apart from the guide surface whereby the follower engages the stop surface rather than the ramp surface and prevents further movement of the cable and the lock member if the cable and lock member are moved relative to the base at a speed in units of length divided by time exceeding an allowable value of speed in units of length divided by time whereby a rotational inertia of the lock member causes the follower to disengage from the ramp surface and travel linearly.

15. The speed-based locking device of claim 14, wherein:

the guide surface comprises a first side wall of a guide channel in the base, the guide channel including a second side wall that is spaced apart from the first side wall.

16. The speed-based locking device of claim 15, wherein:

the second side wall includes first and second portions that are generally linear, and wherein the stop surface comprises an orthogonal surface extending between the first and second portions of the second side wall.

* * * * *